United States Patent [19]

Raz

[11] Patent Number: 4,599,033

[45] Date of Patent: Jul. 8, 1986

[54] LIFTING APPARATUS

[75] Inventor: Dan Raz, Haifa, Israel

[73] Assignee: Electra Mikun (Industries) Ltd., Hod Hasharon, Israel

[21] Appl. No.: 577,261

[22] Filed: Feb. 6, 1984

[30] Foreign Application Priority Data

Feb. 8, 1983 [IL] Israel ..... 67864

[51] Int. Cl.[4] ..... B66F 3/22

[52] U.S. Cl. ..... 414/589; 414/680; 414/917; 187/13

[58] Field of Search ..... 414/589, 590, 917, 680; 187/9 R, 18, 13; 254/9 R, 9 B, 9 C, 122, 124; 182/69, 157, 158

[56] References Cited

U.S. PATENT DOCUMENTS

| | | | |
|---|---|---|---|
| 474,576 | 5/1892 | Cutter . | |
| 1,797,830 | 3/1931 | Koehler . | |
| 2,712,874 | 7/1955 | Murray | 414/917 X |
| 2,785,807 | 3/1957 | Prowinsky | 414/589 |
| 2,896,909 | 7/1959 | Taylor | 414/589 X |
| 2,931,519 | 4/1960 | Beach | 414/589 |
| 3,556,481 | 1/1971 | Mueller . | |
| 3,785,462 | 1/1974 | Coad et al. . | |
| 4,180,252 | 12/1979 | Cushenbery . | |
| 4,370,089 | 1/1983 | Hoster | 414/589 |
| 4,412,774 | 11/1983 | LeGrand et al. | 414/589 |
| 4,447,186 | 5/1984 | Renfro et al. | 414/589 |
| 4,461,455 | 7/1984 | Mills et al. | 414/589 X |
| 4,522,548 | 6/1985 | Oswald et al. | 414/917 X |

FOREIGN PATENT DOCUMENTS

| | | |
|---|---|---|
| 604156 | 10/1934 | Fed. Rep. of Germany . |
| 1175852 | 8/1964 | Fed. Rep. of Germany . |

*Primary Examiner*—Terrance L. Siemens

*Attorney, Agent, or Firm*—Browdy and Neimark

[57] ABSTRACT

A lifting device for cradle supported goods includes cradle engaging lifting arms pivoted to a wheeled chassis. A lever element located between one of the lift arms and the chassis is positioned by a winch and cable to raise the lift arms. An emergency stop block is provided in the event of cable breakage.

5 Claims, 12 Drawing Figures

LIFTING APPARATUS

FIELD OF THE INVENTION

The present invention relates to materials handling equipment generally and more particularly to operator-powered lifting devices.

BACKGROUND OF THE INVENTION

Various types of lifting devices are well known for a wide variety of specific applications. In particular, there is shown and described in applicants' co-pending U.K. Published Patent Application No. 2088327 published June 9, 1982, lifting apparatus especially designed for loading ordnance and projectiles onto aircraft.

The present invention, while employing some of the constructional principles described in applicants' aforesaid co-pending U.K. Published Patent Application No. 2088327 employs additional structural and functional features which are the subject of the present application.

SUMMARY OF THE INVENTION

The present invention seeks to provide storing and lifting apparatus which is particularly suited to the task of storage and loading of ordnance and projectiles onto combat aircraft.

There is thus provided in accordance with an embodiment of the present invention lifting apparatus comprising a cradle arranged to support goods in a predetermined preloaded configuration and a lifting device arranged to selectably engage the cradle for lifting thereof to a desired height, the lifting device comprising a wheeled chassis, cradle engaging lift arms pivotably mounted onto the chassis and apparatus for pivoting the lift arms relative to the chassis to provide lifting of the cradle.

In accordance with a preferred embodiment of the present invention there is provided cradle pitch determination apparatus comprising a pitch determination engagement socket associated with the cradle and pitch determination apparatus associated with the lifting device and including longitudinally displaceable positioning apparatus adapted to engage the pitch determination engagement socket. The longitudinally displaceable positioning apparatus is preferably crank operated.

Additionally in accordance with an embodiment of the present invention, the cradle and lifting device are arranged such that the cradle may be rested on a support surface and be raised directly from the support surface by the lifting device which engages the cradle during a transverse movement along the support surface with respect thereto.

Further in accordance with an embodiment of the present invention, the cradle is provided with movable support elements which permit lowering of the cradle below its normal at rest orientation.

Additionally in accordance with an embodiment of the present invention there is provided emergency stop apparatus operative to prevent undesired lowering of the lift arms due to a cable failure.

BRIEF DESCRIPTION OF THE DRAWINGS

The present invention will be understood and appreciated more fully from the following detailed description taken in conjunction with the drawings in which.

DETAILED DESCRIPTION OF THE INVENTION

Figure 1:
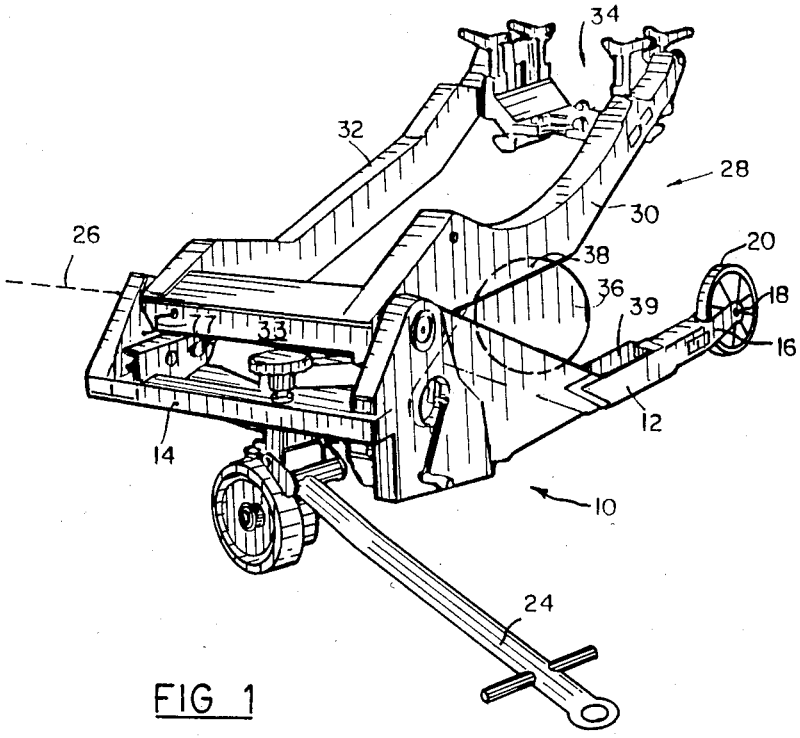
FIG. 1 is a pictorial illustration of the lifting apparatus of the present invention in a raised orientation.
Figure 2A:
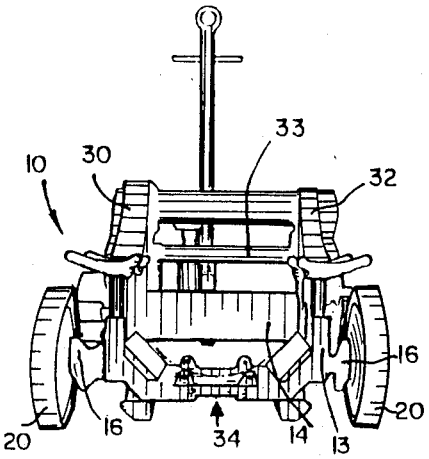
FIGS. 2A and 2B are rear view illustrations of the lifting apparatus of FIG. 1 in respective raised and lowered orientations.
Figure 2B:
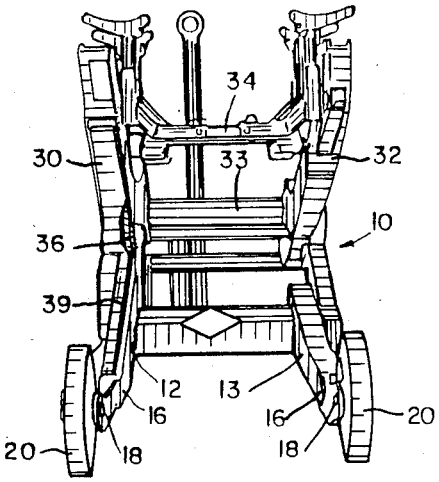

Reference is now made to FIGS. 1, 2A and 2B which illustrate lifting apparatus constructed and operative in accordance with a preferred embodiment of the present invention and comprising a chassis 10 including two generally symmetrically disposed side portions 12 and 13 which are joined at the front by a cross piece 14. Each of the side portions 12 and 13 terminates at its rearward end at a wheel mounting portion 16 which defines a fixed wheel mounting axle 18 onto which is mounted a wheel 20.

A pivotable wheel and associated brake assembly 22 is mounted on cross piece 14 and is operative to support the front of the chassis. A tow bar 24 provides steerability to the assembly 22. Wheel and brake assembly 22 is described in detail and claimed in the aforesaid U.K. Published Patent Application 2088327 of applicants.

Pivotably mounted for rotatable movement about an axis 26 defined by side portions 12 and 13 is a pivotable lifting assembly 28. Lifting assembly 28 comprises a unitary member formed of two generally symmetrically disposed side arms 30 and 32 joined by a front cross member 33 which is arranged for pivotable motion about axis 26. Removably mounted onto the rearward ends of side arms 30 and 32 is an ordnance storage, transport and mounting cradle 34, which will be described hereinbelow in greater detail with reference to FIGS. 4 and 5.

Figure 6A:
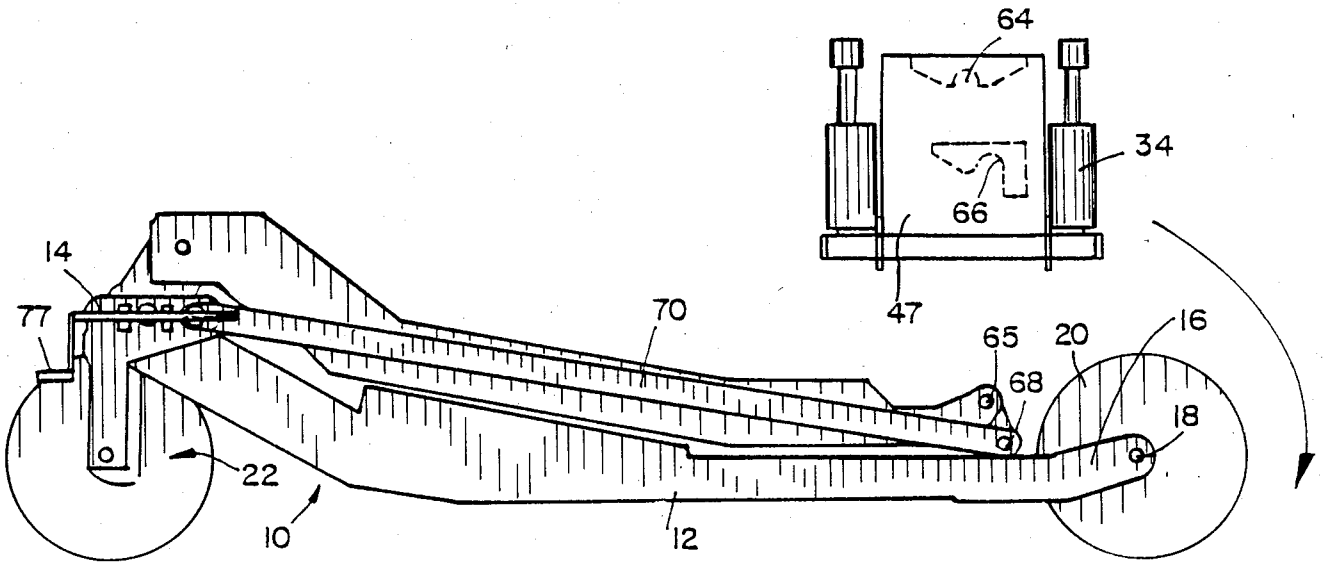
FIGS. 6A, 6B and 6C are schematic illustrations which show the lifting device and cradle in respective disengaged, zero pitch lifted, and forward pitch lifted orientations.

Selectable lifting of lifting assembly 28 is provided by means of a winch driven lever disk 36 which is interposed between side arm 30 and the corresponding side portion 12 of the chassis. It is noted that as distinguished from side arm 32 and side portion 13, side arm 30 and side portion 12 are formed with respective recesses 38 and 39 for accomodating lever disk 36 therewithin when the lifting assembly 28 is disposed in its fully lowered orientation as seen in FIG. 6A. The construction and operation of lever disk 36 is similar in all relevant respects to the construction and operation of disk 70 in the aforesaid U.K. Published Patent Application 2088327.

Figure 7A:
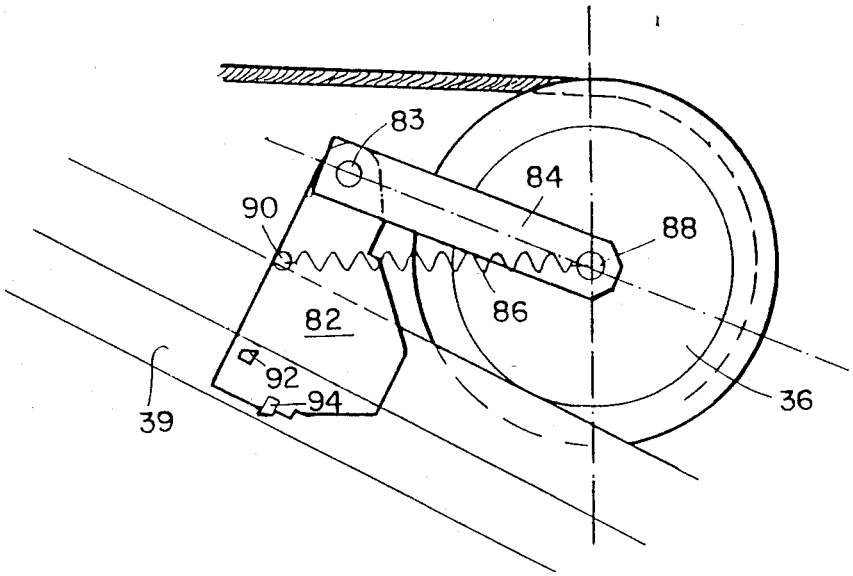
FIGS. 7A and 7B are pictorial illustrations of emergency stop apparatus in respective engaged and disengaged orientations.

Generally stated, lifting and lowering of cradle 34 is provided by selectable positioning of lever disk 36 along a double sided track defined by facing surfaces of side arm 30 and side portion 12 of the chassis. The further forward that the lever disk is disposed in the direction of wheel assembly 22, the greater is the height of cradle 34. The position of the lever disk 36 along the double sided track is determined by the free length of a winch cradle which is looped over the lever disk, as seen in FIG. 7A.

It is a particular feature of the present invention that cradle 34 is separable from lifting assembly 28. As such, a plurality of cradles 34 may be preloaded with ordnance and may be picked up, transported and loaded onto aircraft entirely by the apparatus illustrated and described herein. The particular structure of the cradle 34 which enables this operation to be carried out is illustrated in two alternative operative orientations in FIGS. 3 and 4.

Figure 3:
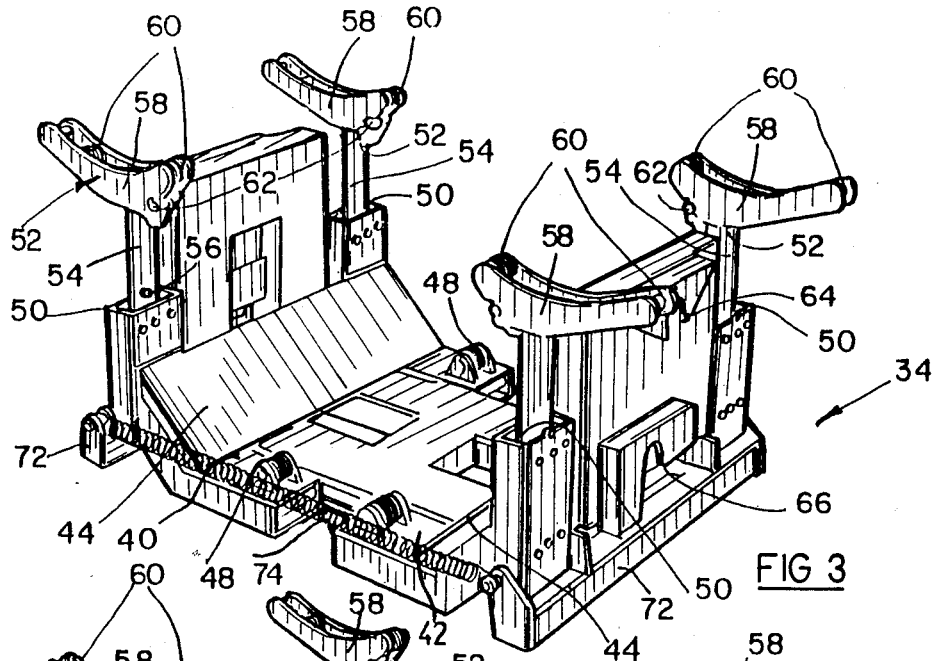
FIGS. 3 and 4 are pictorial illustrations of a cradle constructed and operative in accordance with a preferred embodiment of the present invention in respective normal and raised orientations.
Figure 4:
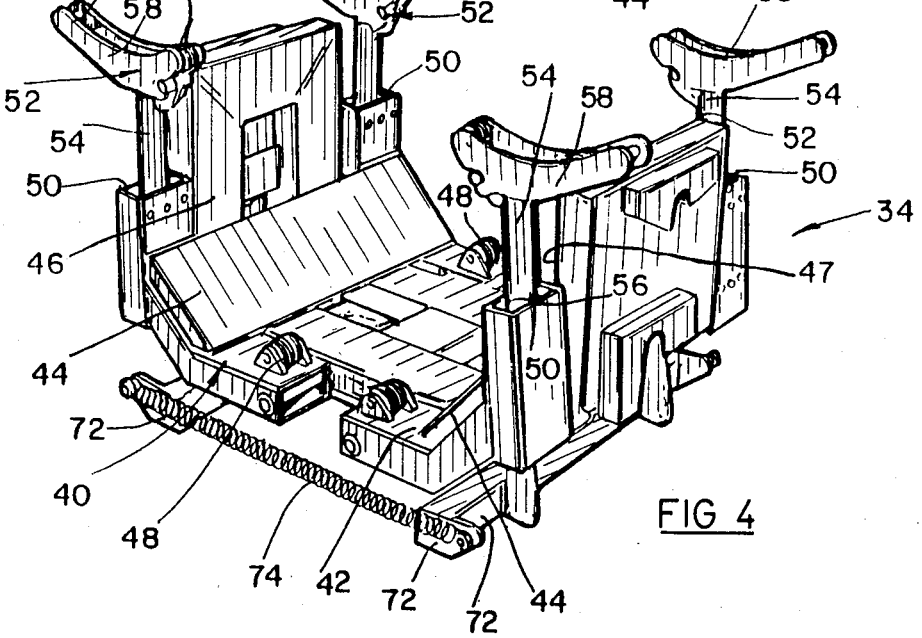

Referring now to FIGS. 3 and 4 it is seen that the cradle comprises a base 40 having a bottom surface 42, inclined intermediate surfaces 44 and side surfaces 46 and 47. Mounted on bottom surface 42 are two pairs of rollers 48 which are arranged to support the lower element of a three element set of ordnance such as three bombs mounted on a bomb rack. Alongside side surfaces 46 and 47 on both sides thereof there are provided sockets 50 for removably receiving mounting assemblies 52 which are arranged to engage and support the upper two elements of a three element set of ordnance.

Mounting assemblies 52 each comprise an upstanding rod 54, having a positioning pin 56 extending transversely therefrom for engagement with the upper rim of socket 50, and a roller mounting head 58 having two rollers 60 mounted therein. Head 58 may be mounted selectably with respect to rod 54, as by means of a pin and socket arrangement 62, for accomodating different sizes and configurations of ordnance.

It is a particular feature of the cradle of the present invention that mounting assemblies 52 may be easily disengaged from sockets 50 to permit replacement thereof by mounting assemblies of different sizes and configurations. Furthermore, sockets 50 may be easily removed from base 40 should the need arise.

Disposed on the outer facing surface of side surfaces 46 and 47 are pickup mounting sockets 64 which are formed with inclined edge surfaces to enable engagement therewith by corresponding mounting pins disposed at the extreme rearward edges of the side arms 30 and 32 of the lifting assembly 28.

According to a preferred embodiment of the invention, there is also provided at each of side surfaces 46 and 47 a pitch determining arm engagement socket 66 which is engagable by a positioning pin 68 attached to a pitch determining arm 70 disposed within arm 32. Only the engagement socket 66 on one side surface will be engaged during the lifting of the cradle, depending upon the orientation of the cradle when lifted by the lifting apparatus.

The provision of a pitch determining capability for cradle 34 is a particular feature of the present invention and will be described hereinafter in connection with FIGS. 6A–6D.

Figure 5:
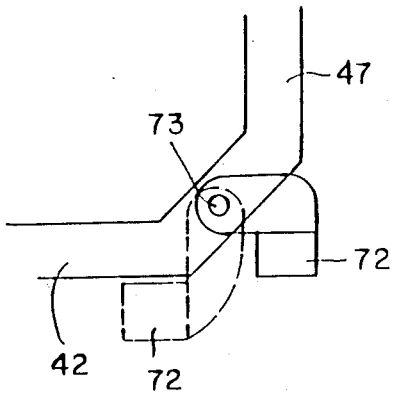
FIG. 5 is a schematic cut away side view illustration of a portion of the cradle of FIGS. 3 and 4.

It is a particular feature of the present invention that cradle 34 is provided with retractable foot elements 72 which are pivotably mounted with respect to bottom surface 42 so as to selectably lie in respective extended and retracted orientations. FIG. 5 illustrates the mounting of one of said foot elements 72 about a pivot axis 73. The solid line on FIG. 5 and the illustration in FIG. 3 show the foot elements 72 in a retracted orientation, arranged to the side of bottom surface 42, while the dotted lines on FIG. 5 and the illustration in FIG. 4 show the foot elements 72 in an extended orientation underlying bottom surface 42 thus lifting it off a support surface by approximately 40 mm. The two foot elements 72 are preferably joined by a tension spring 74 so as to provide positive, overcenter locking orientation of the foot elements in both of the two alternative orientations.

The provision of foot elements 72 enables the cradle to be stored in the extended orientation of FIG. 5, permitting pick up engagement therewith by the lifting apparatus of the present invention. Once the lifting apparatus picks up a cradle, the foot elements 72 may be shifted manually to their retracted orientation, enabling the cradle, once engaged by the lifting apparatus, to be lowered below its FIG. 5 orientation as required by the loading procedures of certain aircraft. In such a way, the support of the cradles on blocks or other external elements is obviated.

Figure 6B:
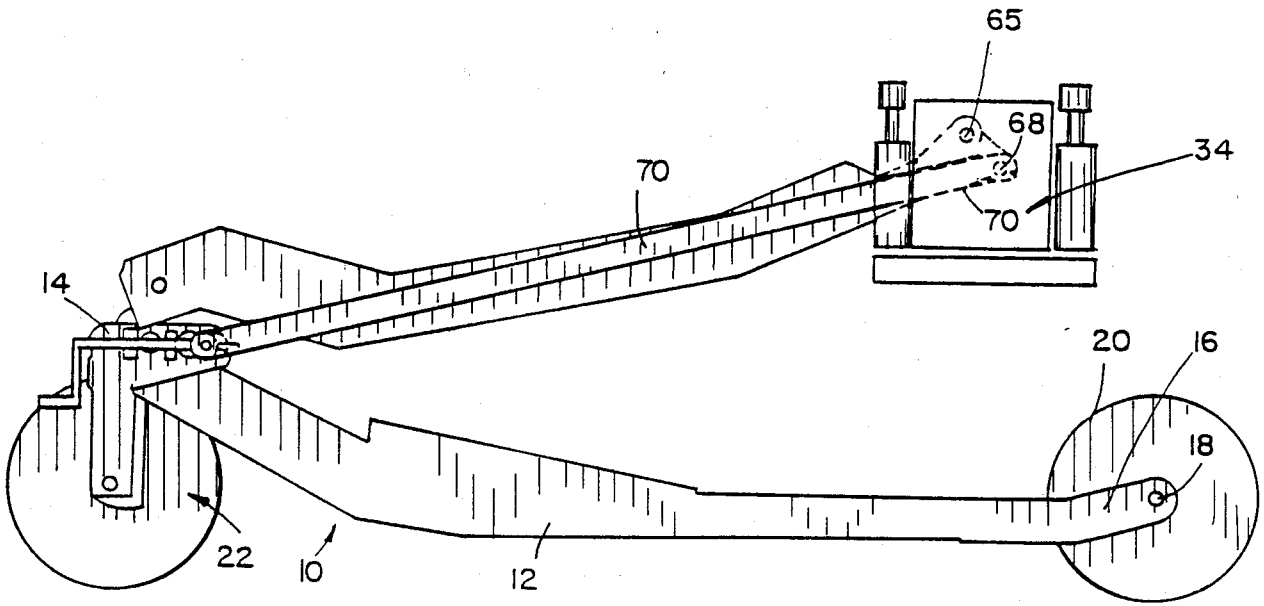
Figure 6C:
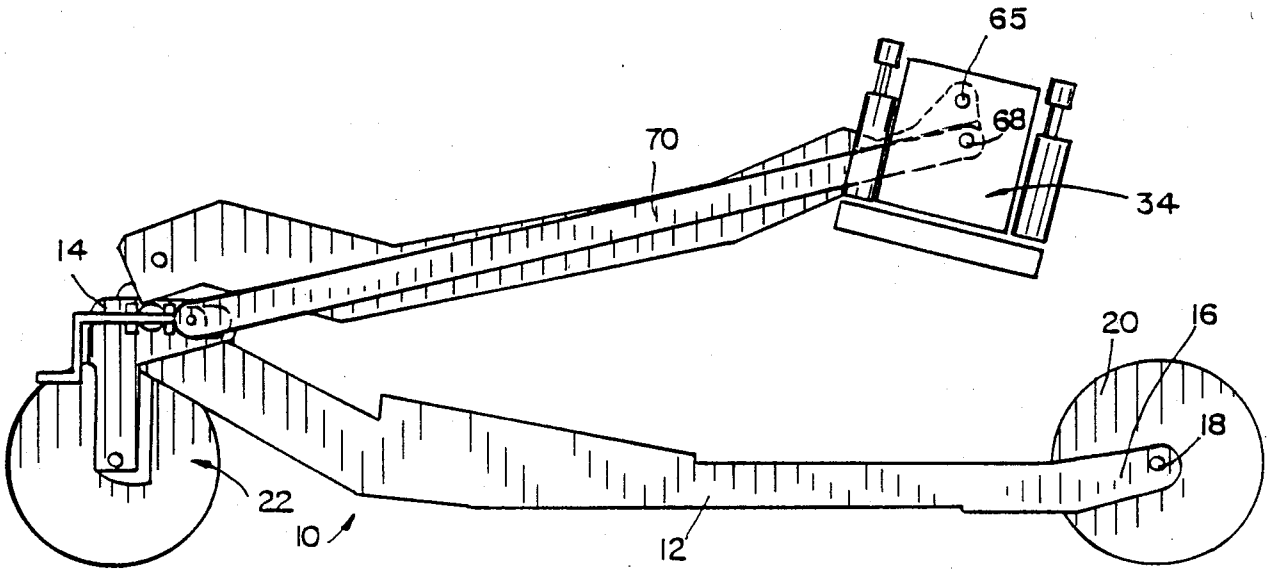
Figure 6D:
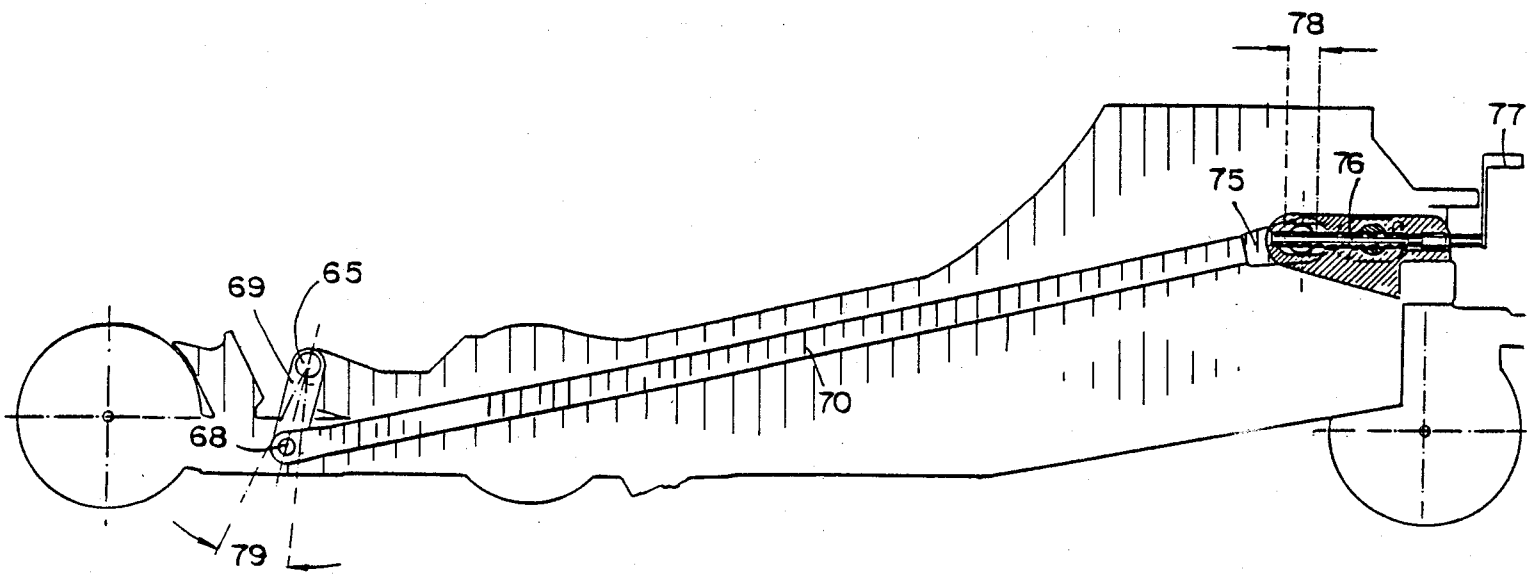
FIG. 6D is a detailed schematic illustration of the pitch determination mechanism of the lifting device and cradle.

Reference is now made to FIGS. 6A–6D which illustrate the structure and operation of the apparatus incorporated in the lifting apparatus and in the cradle 34 for enabling a cradle to be picked up and then positioned with a desired pitch. FIG. 6D is a detailed illustration of the pitch determination apparatus of the present invention. It comprises a pitch determining arm 70 disposed within arm 32 of the lifting apparatus which is pivotable affixed at one end to positioning pin 68 which, in turn is pivotable affixed to support pin 65 by connecting member 69.

A desired pitch may be produced in the orientation of the cradle 34 by means of selectable extension or retraction of pitch determining arm 70. Selectable extension and retraction of pitch determining arm 70 is provided by any suitable means such as a conventional threaded crank 76 which engages a correspondingly threaded socket 75 which is attached to the pitch determining arm 70, whereby rotation of the crank in a first direction of rotation produces extension of arm 70 and rotation of the crank in an opposite direction produces retraction of arm 70. As screw member 76 is rotated in the first direction, as by means of handle 77, pitch determining arm 70 is extended through the distance 78. Extension of arm 70 causes a corresponding pivotal movement of connecting member 69 through an arc 79, resulting in a change of pitch of the cradle 34.

With reference to FIGS. 6A, 6B and 6C there is shown a cut away illustration of arm 32 of the lifting apparatus, as well as the facing side surface 47 of the cradle 34. In FIG. 6A, the lifting apparatus is shown in its fully lowered orientation prior to engagement with the cradle. FIG. 6B illustrates engagement between the respective pins 65 and 68 of the lifting apparatus and sockets 64 and 66 on the cradle which is produced by rolling movement of the lifting apparatus on a supporting surface on which cradle 34 rests. In FIG. 6B the lifting apparatus is illustrated in a raised, zero pitch orientation. FIG. 6C illustrates a change in pitch of cradle 34 created by retraction of pitch determining arm 70.

In summary, it may be appreciated that the cradle and lifting apparatus of the present invention provide a wide range of flexibility of operation and lifting of a load to a desired height at a desired pitch, all produced by manual or powered manipulation, as desired.

Figure 7B:
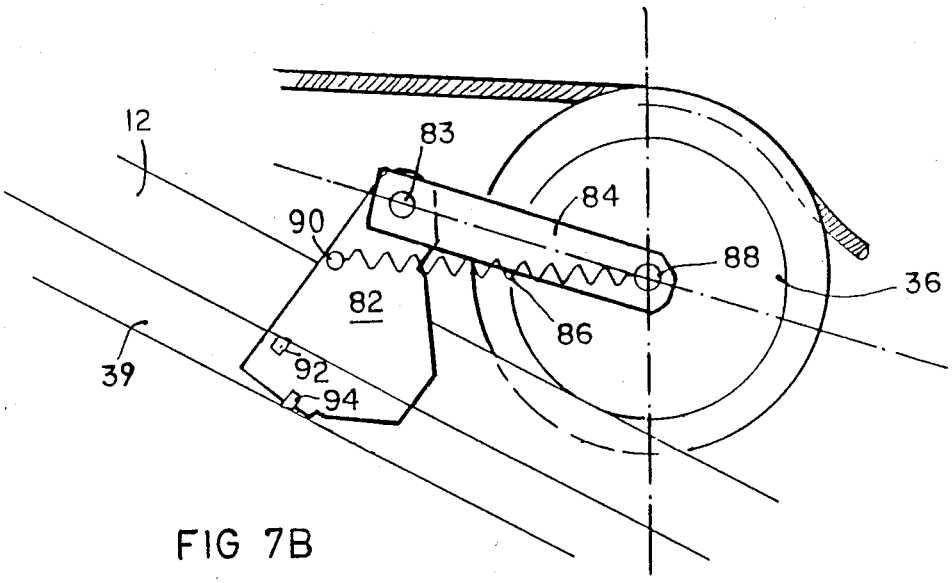

Reference is now made to FIGS. 7A and 7B which illustrate an emergency stop mechanism associated with lever disk 36 for preventing runaway movement of the lever disk 36 and sudden lowering of the cradle 34 in the event of a cable break. The emergency stop mechanism comprises an upside-down T-shaped track engagement block 82 which is pivotably mounted about a pivot axis 83 onto a connection rod 84, which is in turn pivotably mounted at the center of lever disk 36. A spring 86 connects a pin 88 mounted onto connection rod 84 to a second pin 90 mounted at an adjacent location on block 82.

Spring 86 is operative to retain track engagement block 82 in the illustrated orientation relative to lever disk 36 as lever disk 36 is moved by means of the cable and winch along the track formed by recess 39 in arm 12 of the lifting apparatus. It will be appreciated, however, that spring 86 is not strong enough to dislodge track engagement block 82 from the track during movement. Track engagement block 82 defines two brake strips 92 and 94. Brake strip 92 extends along the upper portion of the cross piece of the upside-down T-shaped block underneath the rim of the track formed by recess 39. Brake strip 94 extends along the bottom of the track engagement block. During normal operation, as illustrated in FIG. 7A, neither brake strip 92 nor brake strip 94 is in contact with recess 39, and the track engagement block moves unimpeded through the track.

In the event that the cable should snap, as illustrated in FIG. 7B, lever disk 36 will roll down arm 12 at an increased rate. This movement of lever disk 36 stretches spring 86 and causes connection rod 84 to pivot about pivot axis 83, in turn causing track engagement block 82 to pivot about pin 90 until brake strips 92 and 94 engage recess 39 preventing further movement of block 82 or disk 36. The track engagement block will remain in this braked orientation until the cable about lever disk 36 is repaired.

It will be appreciated by persons skilled in the art that the present invention is not limited to what has been specifically shown and described hereinabove. Rather, the scope of the invention is soleley limited by the claims which follow.

I claim:

1. Lifting apparatus comprising:

a cradle arranged to support goods in a predetermined configuration; and a lifting device arranged selectably to engage said cradle for lifting thereof to a desired height, said lifting device including:

a wheeled chassis;

cradle engaging lift arms pivotably mounted onto said chassis; and means for moving said lift arms relative to said chassis to provide lifting of said cradle including:

a lever element interposed between at least one of said lift arms and said chassis, whereby the location of said lever element determined the extent to which said lift arms are raised with respect to said chassis;

cable means engaging said lever for selectable positioning thereof;

winch means operable to engage said cable means for selectable positioning of said lever element; and emergency stop means associated with said lever element for preventing undesired movement of said lever element in the event of cable breakage including a track engagement block defining brake means adapted to engage said chassis in the event of cable breakage.

2. Lifting apparatus according to claim 1 and wherein said lifting device comprises cradle pitch determination means for selectably determining the pitch of said cradle when engaged by said lift arms in a lifted orientation.

3. Lifting apparatus according to claim 2 and wherein said cradle comprises a pitch determination engagement socket and said pitch determination means comprises a longitudinally displaceable positioning element adapted to engage said socket, whereby the orientation of said element determines the pitch of said cradle.

4. Lifting apparatus according to claim 1 and wherein said cradle and lifting device are arranged such that said cradle may be rested on a support surface and engaged for lifting thereof by said lift arms in response to transverse motion of said wheeled chassis on said support surface.

5. Lifting apparatus comprising:

a cradle arranged to support goods in a predetermined configuration; and a lifting device arranged selectably to engage said cradle for lifting thereof to a desired height, said lifting device including:

a wheeled chassis;

cradle engaging lift arms pivotably mounted onto said chassis; and means for moving said lift arms relative to said chassis to provide lifting of said cradle from a predetermined level at which engagement of the cradle by said lift arms takes place, said cradle comprising selectably retractable support elements which, when retracted, enable the cradle to be lowered by said lifting device to a level below the level at which engagement of the cradle by said lift arms takes place.

* * * * *